US012012958B2

(12) United States Patent
Ueno et al.

(10) Patent No.: US 12,012,958 B2
(45) Date of Patent: Jun. 18, 2024

(54) CENTRIFUGAL COMPRESSOR

(71) Applicant: IHI Corporation, Tokyo (JP)

(72) Inventors: Takahiro Ueno, Tokyo (JP); Atsushi Yonemura, Tokyo (JP); Ryota Sakisaka, Tokyo (JP)

(73) Assignee: IHI Corporation, Tokyo (JP)

( * ) Notice: Subject to any disclaimer, the term of this patent is extended or adjusted under 35 U.S.C. 154(b) by 0 days.

(21) Appl. No.: 17/816,770

(22) Filed: Aug. 2, 2022

(65) Prior Publication Data

US 2022/0372977 A1 Nov. 24, 2022

Related U.S. Application Data

(63) Continuation of application No. PCT/JP2021/005341, filed on Feb. 12, 2021.

(30) Foreign Application Priority Data

May 19, 2020 (JP) ..... 2020-087639

(51) Int. Cl.
*F04C 18/02* (2006.01)

(52) U.S. Cl.
CPC ..... *F04C 18/0215* (2013.01); *F04C 18/0284* (2013.01)

(58) Field of Classification Search
None
See application file for complete search history.

(56) References Cited

U.S. PATENT DOCUMENTS

| | | | | |
|---|---|---|---|---|
| 4,122,668 | A | 10/1978 | Chou et al. | |
| 6,012,897 | A | 1/2000 | Sabnis et al. | |
| 2016/0281727 | A1* | 9/2016 | Lardy | F04D 13/06 |
| 2018/0355890 | A1 | 12/2018 | Sishtla | |
| 2020/0141259 | A1* | 5/2020 | Inoue | B29C 65/08 |

FOREIGN PATENT DOCUMENTS

| | | | | |
|---|---|---|---|---|
| EP | 3 056 690 | A1 | 8/2016 | |
| EP | 3056690 | A1 * | 8/2016 | F01D 17/143 |
| JP | 3-68529 | U | 7/1991 | |
| JP | 11-062894 | A | 3/1999 | |
| JP | 3063402 | B2 | 7/2000 | |
| JP | 2007-255381 | A | 10/2007 | |
| JP | 2008-309123 | A | 12/2008 | |
| JP | 2011-153570 | A | 8/2011 | |
| JP | 2014-152614 | A | 8/2014 | |
| JP | 2018-510289 | A | 4/2018 | |

(Continued)

OTHER PUBLICATIONS

English Translation WO-2019241524-A1 (Year: 2019).*

(Continued)

*Primary Examiner* — Shafiq Mian
(74) *Attorney, Agent, or Firm* — Oblon, McClelland, Maier & Neustadt, L.L.P.

(57) ABSTRACT

A centrifugal compressor includes: a scroll housing including a scroll flow path; a shroud piece attached to the scroll housing at a position radially inside the scroll flow path and including a shroud portion that faces a compressor impeller in a radial direction; and a throttling portion arranged in a gap formed between the scroll housing and the shroud piece.

6 Claims, 12 Drawing Sheets

(56) References Cited

FOREIGN PATENT DOCUMENTS

| | | | | | |
|---|---|---|---|---|---|
| KR | 10-2012-0063089 | A | | 6/2012 | |
| KR | 1020120063089 | A | * | 6/2012 | |
| WO | WO 2018/220713 | A1 | | 12/2018 | |
| WO | WO-2018220713 | A1 | * | 12/2018 | ..... B21D 39/06 |
| WO | WO 2019/241524 | A1 | | 12/2019 | |
| WO | WO-2019241524 | A1 | * | 12/2019 | |
| WO | WO 2020/031507 | A1 | | 2/2020 | |

OTHER PUBLICATIONS

English Translation KR1020120063089A (Year: 2012).*
English Translation EP-3056690-A1 (Year: 2016).*
English Translation WO-2018220713-A1 (Year: 2018).*
International Search Report dated Apr. 20, 2021 in PCT/JP2021/005341 filed on Feb. 12, 2021, 3 pages.
Japanese Office Action dated Dec. 26, 2023 in Japanese Application 2022-524890, 3 pages.
German Office Action dated Nov. 9, 2023 in German Application 112021000566.9, 4 pages.

* cited by examiner

CENTRIFUGAL COMPRESSOR

CROSS REFERENCE TO RELATED APPLICATIONS

This application is a continuation application of International Application No. PCT/JP2021/005341, filed on Feb. 12, 2021, which claims priority to Japanese Patent Application No. 2020-087639 filed on May 19, 2020, the entire contents of which are incorporated herein by reference.

BACKGROUND ART

Technical Field

The present disclosure relates to a centrifugal compressor.

Patent Literature 1 discloses a centrifugal compressor comprising a compressor housing and a movable portion. The compressor housing is divided into a first compressor housing and a second compressor housing. A gap is formed between the first compressor housing and the second compressor housing. The movable portion is arranged in the gap. The movable portion is configured to move within the gap.

CITATION LIST

Patent Literature

Patent Literature 1: JP 2007-255381 A

SUMMARY

Technical Problem

In Patent Literature 1, split surfaces between the first compressor housing and the second compressor housing are exposed to the outside. The split surfaces may allow foreign matter to enter inside the compressor housing from an outside.

The present disclosure provides a centrifugal compressor that can prevent foreign matter from entering inside the compressor housing.

Solution to Problem

To solve the above problem, a centrifugal compressor according to one aspect of the present disclosure includes: a scroll housing including a scroll flow path; a shroud piece attached to the scroll housing at a position radially inside the scroll flow path and including a shroud portion that faces a compressor impeller in a radial direction; and a throttling portion arranged in a gap formed between the scroll housing and the shroud piece.

The throttling portion may be arranged at a position spaced apart from the shroud portion with respect to a leading-edge of the compressor impeller.

The centrifugal compressor may include a seal arranged between the scroll housing and the shroud piece.

The shroud piece may form a part of an inner surface of the scroll flow path.

The scroll housing may include a contacting portion that is arranged radially outside the throttling portion and that contacts the shroud piece in an axial direction of the compressor impeller.

The shroud piece may include an abradable material.

The shroud piece may include a hollow section.

Effects of Disclosure

According to the present disclosure, foreign matter can be prevented from entering inside the compressor housing.

DESCRIPTION OF EMBODIMENTS

Embodiments of the present disclosure will be described in detail below with reference to the accompanying drawings. Specific dimensions, materials, and numerical values described in the embodiments are merely examples for a better understanding, and do not limit the present disclosure unless otherwise specified. In this specification and the drawings, duplicate explanations are omitted for elements having substantially the same functions and configurations by assigning the same reference sign. Furthermore, elements not directly related to the present disclosure are omitted from the figures.

Figure 1:
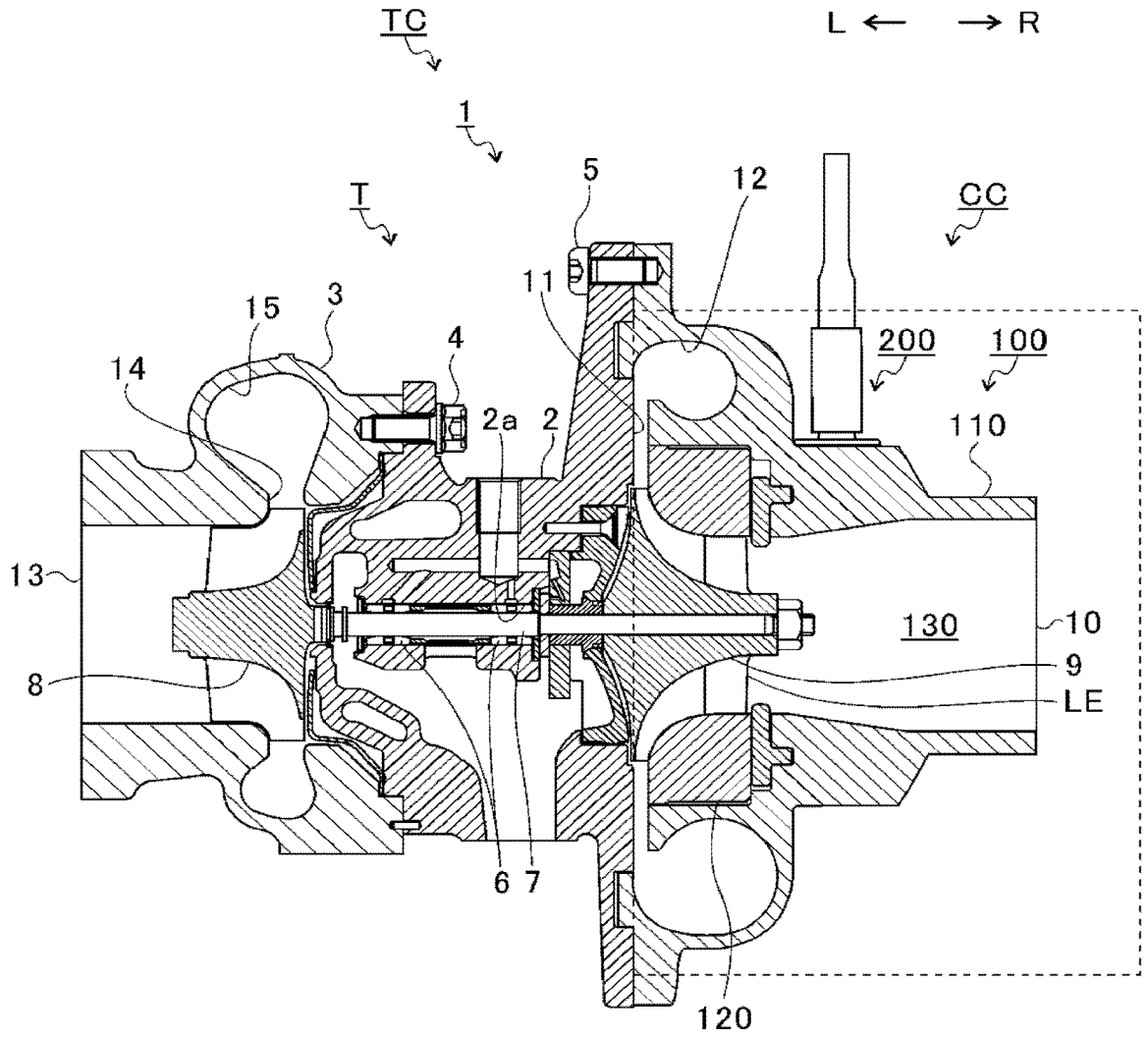
FIG. 1 is a schematic cross-sectional view of a turbocharger.

FIG. 1 is a schematic cross-sectional view of a turbocharger TC. A direction indicated by arrow L in FIG. 1 is described as the left side of the turbocharger TC. A direction indicated by arrow R in FIG. 1 is described as the right side of the turbocharger TC. As shown in FIG. 1, the turbocharger TC comprises a turbocharger body 1. The turbocharger body 1 includes a bearing housing 2, a turbine housing 3, a compressor housing 100, and a link mechanism 200. Details of the link mechanism 200 will be described below. The turbine housing 3 is connected to the left side of the bearing housing 2 by fastening bolts 4. The compressor housing 100 is connected to the right side of the bearing housing 2 by fastening bolts 5.

An accommodation hole 2*a* is formed in the bearing housing 2. The accommodation hole 2*a* passes through in the left-to-right direction of the turbocharger TC. A bearing 6 is arranged in the accommodation hole 2*a*. In FIG. 1, a full floating bearing is shown as an example of the bearing 6. However, the bearing 6 may be any other radial bearing such as a semi-floating bearing or a rolling bearing. A part of the shaft 7 is arranged in the accommodation hole 2*a*. The shaft 7 is rotatably supported by the bearing 6. A turbine impeller 8 is provided at a left end of the shaft 7. The turbine impeller 8 is rotatably accommodated in the turbine housing 3. A compressor impeller 9 is provided at a right end of the shaft 7. The compressor impeller 9 is rotatably accommodated in the compressor housing 100.

An inlet 10 is formed in the compressor housing 100. The inlet 10 opens to the right side of the turbocharger TC. The inlet 10 is connected to an air cleaner (not shown). A diffuser flow path 11 is formed between the bearing housing 2 and the compressor housing 100. The diffuser flow path 11 pressurizes air. The diffuser flow path 11 is formed in an annular shape from an inner side to an outer side in a radial direction of the shaft 7 (compressor impeller 9) (hereinafter simply referred to as the radial direction). The diffuser flow path 11 is connected to the inlet 10 via the compressor impeller 9 at a radially inner part.

A compressor scroll flow path 12 is formed in the compressor housing 100. The compressor scroll flow path 12 is formed in an annular shape. The compressor scroll flow path 12 is located radially outside the compressor impeller 9. The compressor scroll flow path 12 is connected to an intake port of an engine (now shown) and the diffuser flow path 11. When the compressor impeller 9 rotates, air is sucked into the compressor housing 100 from the inlet 10. The intake air is pressurized and accelerated while passing through blades of the compressor impeller 9. The pressurized and accelerated air is pressurized in the diffuser flow path 11 and the compressor scroll flow path 12. The pressurized air flows out of a discharge port (not shown) and is directed to the intake port of the engine.

A part including the compressor housing 100 in the turbocharger TC functions as a centrifugal compressor (compressor) CC. Hereinafter, the centrifugal compressor CC is described as being driven by the turbine impeller 8. However, the centrifugal compressor CC is not limited thereto, and may be driven by an engine (not shown) or by an electric motor (not shown). As such, the centrifugal compressor CC may be incorporated in a device other than the turbocharger TC, or may be a stand-alone unit. The centrifugal compressor CC includes the compressor housing 100, the compressor impeller 9, and the link mechanism 200 described later.

An outlet 13 is formed in the turbine housing 3. The outlet 13 opens to the left side of the turbocharger TC. The outlet 13 is connected to an exhaust gas purifier (not shown). A connecting flow path 14 and a turbine scroll flow path 15 are formed in the turbine housing 3. The turbine scroll flow path 15 is located radially outside the turbine impeller 8. The connecting flow path 14 is located between the turbine impeller 8 and the turbine scroll flow path 15.

The turbine scroll flow path 15 is connected to an gas inlet (not shown). Exhaust gas discharged from an engine exhaust manifold (not shown) is directed to the gas inlet. The connecting flow path 14 connects the turbine scroll flow path 15 to the outlet 13 via the turbine impeller 8. The exhaust gas led from the gas inlet to the turbine scroll flow path 15 is led to the outlet 13 through the connecting flow path 14 and blades of the turbine impeller 8. The exhaust gas rotates the turbine impeller 8 while passing therethrough.

A rotational force of the turbine impeller 8 is transmitted to the compressor impeller 9 via the shaft 7. As described above, the air is pressurized by the rotational force of the compressor impeller 9 and directed to the intake port of the engine.

Figure 2:
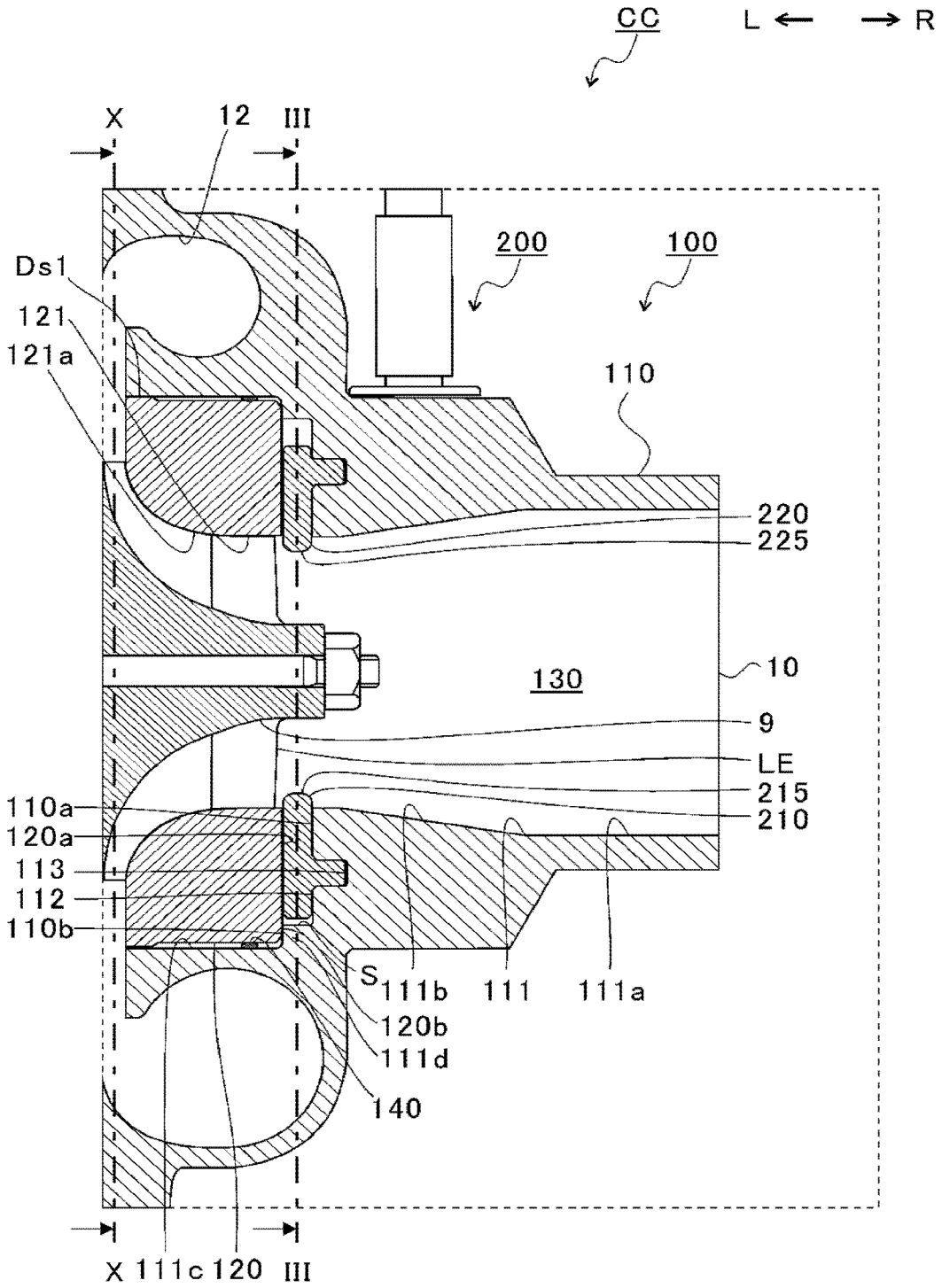
FIG. 2 is an extract of an area enclosed by dashed lines in FIG. 1.

FIG. 2 is an extract of an area enclosed by dashed lines in FIG. 1. As shown in FIG. 2, the compressor housing 100 is divided into a scroll housing 110 and a shroud piece 120. The scroll housing 110 and the shroud piece 120 are formed separately.

A through hole 111 is formed in the scroll housing 110. The through hole 111 passes through the scroll housing 110 in an axial direction of the shaft 7 (hereinafter simply referred to as the axial direction). The through hole 111 includes the inlet 10 at an end spaced apart from the bearing housing 2. Furthermore, the scroll housing 110 includes a connecting surface that is connected to the bearing housing 2, and the compressor scroll flow path 12 is formed near the connecting surface.

The through hole 111 includes a parallel portion 111*a*, a tapered portion 111*b*, and a hollow portion 111*c*. The parallel portion 111*a* is arranged in the through hole 111 at a position most spaced apart from the bearing housing 2. An inner diameter of the parallel portion 111*a* is substantially constant throughout the axial direction. The tapered portion 111*b* is arranged closer to the bearing housing 2 with respect to the parallel portion 111*a*. The tapered portion 111*b* is continuous with the parallel portion 111*a*. An inner diameter of the tapered portion 111*b* decreases as approaching the bearing housing 2.

The hollow portion 111*c* is arranged closer to the bearing housing 2 with respect to the tapered portion 111*b*. The hollow portion 111*c* is recessed radially outward with respect to the tapered portion 111*b* and the parallel portion 111*a*. In other words, an inner diameter of the hollow portion 111*c* is larger than the inner diameters of the tapered portion 111*b* and the parallel portion 111*a*. The shroud piece 120 is arranged in the hollow portion 111*c*. The shroud piece 120 is in contact with the hollow portion 111*c*. The shroud piece 120 is attached to the scroll housing 110 at a position radially inside the compressor scroll flow path 112.

In this embodiment, the shroud piece 120 is press-fitted into the hollow portion 111*c*. However, the shroud piece 120 is not limited thereto, and may be attached to the scroll housing 110 by an adhesive. The shroud piece 120 may also be attached to the scroll housing 110 via a fitting ring (snap ring). The shroud piece 120 may also include a flange portion (not shown), and the flange portion may be screwed to the scroll housing 110. The shroud piece 120 is accommodated in the hollow portion 111*c* (scroll housing 110).

A through hole 121 is formed in the shroud piece 120. The through hole 121 passes through the shroud piece 120 in the axial direction. The smallest inner diameter of the through hole 121 is substantially equal to the smallest inner diameter of the through hole 111 (tapered portion 111*b*). A shroud portion 121*a* is formed on an inner wall of the through hole 121. The shroud portion 121*a* faces the compressor impeller 9 from the radially outside. An outer diameter of the compressor impeller 9 increases as being spaced apart from a leading-edge LE of the blades of the compressor impeller 9. The shroud portion 121*a* has a shape similar to an outer shape of the compressor impeller 9. An inner diameter of the shroud portion 121*a* is slightly larger than the outer diameter of the compressor impeller 9. Accordingly, the inner diameter of the shroud portion 121*a* increases as moving from the leading-edge LE toward the bearing housing 2.

The shroud piece 120 includes an abradable material. In this embodiment, at least the shroud portion 121*a* of the shroud piece 120 is composed of abradable material. Accordingly, the shroud piece 120 is cut by the compressor impeller 9 when the rotating compressor impeller 9 contacts the shroud piece 121*a*. As a result, the gap between the shroud portion 121*a* and the compressor impeller 9 can be reduced. However, the shroud piece 120 may not include the abradable material.

An intake flow path 130 is formed by the through hole 111 in the scroll housing 110 and the through hole 121 in the shroud piece 120. In other words, the intake flow path 130 is formed in the compressor housing 100. The intake flow path 130 runs from the air cleaner (not shown) through the inlet 10 to the diffuser flow path 11 (see FIG. 1). A part closer to the air cleaner (intake port 10) in the intake flow path 130 is referred to as an upstream side in a flow of the intake air, and a part closer to the diffuser flow path 11 in the intake flow path 130 is referred to as a downstream side in the flow of the intake air.

The compressor impeller 9 is arranged in the intake flow path 130. For example, the intake flow path 130 (through holes 111, 121) has a circular shape around a rotational axis of the compressor impeller 9 in a cross-section perpendicular to the axial direction. However, the cross-sectional shape of the intake flow path 130 is not limited thereto and may be, for example, elliptical.

One end of split surfaces Ds1 between the scroll housing 110 and the shroud piece 120 is located on an inner surface of the diffuser flow path 11, and the other end is located on an inner surface of the intake flow path 130 at a position upstream of the leading-edge LE. In this embodiment, the split surfaces Ds1 extend from the diffuser flow path 11 to the intake flow path 130. The split surfaces Ds1 are located within the compressor housing 100 from one end to the other end. The split surfaces Ds1 are not exposed on the outer surface of the compressor housing 100.

A seal 140 is arranged between the hollow portion 111*c* of the scroll housing 110 and the shroud piece 120. The seal 140 is arranged in the middle of the split surfaces Ds1. The seal 140 curbs a flow rate of air flowing through a gap between the scroll housing 110 and the shroud piece 120. However, the seal 140 is not essential. The seal 140 may not be arranged between the hollow portion 111*c* and the shroud piece 120.

An opposing surface 120*a* is formed on a lateral surface (axial end surface) of the shroud piece 120 at a radially inner part. An opposing surface 110*a* that faces the opposing surface 120*a* in the axial direction is formed on the scroll housing 110. The opposing surface 110*a* is located closer to the compressor impeller 9 with respect to the tapered portion 111*b*, and is spaced apart from the compressor impeller 9 with respect to the hollow portion 111*c*. The opposing surface 120*a* of the shroud piece 120 is spaced apart from the opposing surface 110*a* of the scroll housing 110 in the axial direction. In other words, a gap S is formed between the scroll housing 110 and the shroud piece 120. The gap S is arranged upstream of the compressor impeller 9 in the flow of the intake air, in the axial direction of the compressor impeller 9. In other words, the gap S is arranged closer to the inlet 10 with respect to the leading-edge LE. The gap S is arranged closer to the bearing housing 2 with respect to the tapered portion 111*b*. Throttling portions (first movable portion 210 and second movable portion 220), which will be described in detail later, are arranged in the gap S. In other words, the first movable portion 210 and the second movable portion 220 are arranged at positions spaced apart from the shroud portion 121*a* with respect to the leading-edge LE of the compressor impeller 9.

A contacting surface 120*b* is formed on a lateral surface (axial end surface) of the shroud piece 120 at a radially outer part. A contacting surface 110*b* that faces the contacting surface 120*b* in the axial direction is formed on the scroll housing 110. The contacting surface 120*b* of the shroud piece 120 is in contact with the contacting surface 110*b* of the scroll housing 110 in the axial direction. The contacting surface 110*b* of the scroll housing 110 is located closer to the compressor impeller 9 with respect to the opposing surface 110*a*. In other words, the scroll housing 110 includes a protrusion (contacting portion) 111*d* that protrudes toward the compressor impeller 9 from the opposing surface 110*a*. In this embodiment, the contacting portion 111*d* that includes the contacting surface 110*b* contacting the shroud piece 120 in the axial direction is formed in the scroll housing 110. The contacting portion 111*d* is arranged radially outside the first movable portion 210 and the second movable portion 220. The contacting portion 111*d* contacts the shroud piece 120 to determine the axial position of the shroud piece 120. Furthermore, the contacting portion 111*d* is provided in the scroll housing 110 so that a press-fit overlap with the shroud piece 120 can be reduced. However, the contacting portion 111*d* is not limited thereto, and may be provided on the shroud piece 120.

Figure 3:
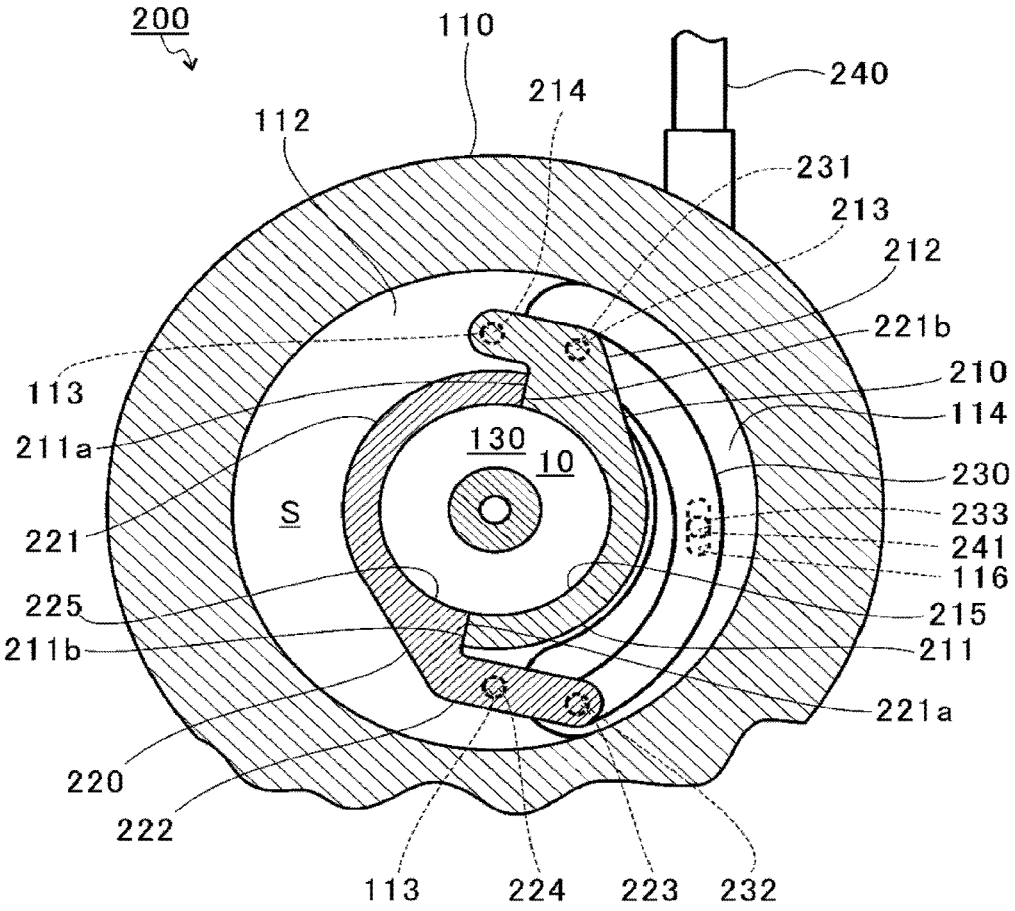
FIG. 3 is a cross-sectional view taken along line in FIG. 2.

FIG. 3 is a cross-sectional view taken along III-III line in FIG. 2. As shown in FIG. 3, the gap S includes an accommodation groove 112, bearing holes 113, and an accommodation hole 114. In this embodiment, the accommodating groove 112, the bearing holes 113, and the accommodating hole 114 are formed in the scroll housing 110. However, the accommodating groove 112, the bearing holes 113, and the accommodating hole 114 are not limited thereto, and may be formed in the shroud piece 120.

The accommodation groove 112 is formed in a substantially annular shape. The accommodation groove 112 is connected to the through hole 111 at a radially inner part. The bearing holes 113 are formed in the accommodation groove 112 at a wall surface closer to the inlet 10. The bearing hole 113 extends from the accommodation groove 112 toward the inlet 10 in the axial direction. The bearing holes 113 are provided spaced apart from each other in a rotational direction of the shaft 7 (hereinafter simply referred to as the rotational direction or circumferential direction). In this embodiment, two bearing holes 113 are provided. The two bearing holes 113 are arranged at positions spaced apart from each other by 180 degrees in the rotational direction.

The accommodation hole 114 is formed in the accommodation groove 112 at the wall surface closer to the inlet 10. The accommodation hole 114 is recessed from the accommodation groove 112 toward the inlet 10 in the axial direction. The accommodation hole 114 has a substantially arc shape. The accommodation hole 114 is spaced apart from the two bearing holes 113 in the circumferential direction.

The link mechanism 200 includes the first movable portion 210, the second movable portion 220, a connecting portion 230, and a rod 240. The link mechanism 200 is arranged upstream of the compressor impeller 9 in the intake flow path 130, in the axial direction.

The first movable portion 210 is arranged in the accommodation groove 112. The first movable portion 210 includes a curved portion 211 and an arm portion 212. The curved portion 211 extends in the circumferential direction of the compressor impeller 9. The curved portion 211 has a substantially semi-circular arc shape. In the curved portion 211, a first end surface 211*a* and a second end surface 211*b* in the circumferential direction extend parallel to the radial direction and the axial direction. However, the first end surface 211*a* and the second end surface 211*b* may be inclined with respect to the radial direction and the axial direction.

The arm portion 212 is provided on the curved portion 211 at an area closer to the first end surface 211*a*. The arm portion 212 is continuous with the first end surface 211*a* of the curved portion 211 toward outer side in the radial direction. Furthermore, the arm portion 212 extends from the first end surface 211*a* toward the second movable portion 220.

The second movable portion 220 is arranged in the accommodation groove 112. The second movable portion 220 includes a curved portion 221 and an arm portion 222. The curved portion 221 extends in the circumferential direction of the compressor impeller 9. The curved portion 221 has a substantially semi-circular arc shape. In the curved portion 221, a first end surface 221*a* and a second end surface 221*b* in the circumferential direction extend parallel to the radial direction and the axial direction. However, the first end surface 221*a* and the second end surface 221*b* may be inclined with respect to the radial direction and the axial direction.

The arm portion 222 is provided on the curved portion 221 at an area closer to the first end surface 221*a*. The arm portion 222 is continuous radially outward from the first end surface 221*a* of the curved portion 221. Furthermore, the arm portion 222 extends from the first end surface 221*a* toward the first movable portion 210.

The curved portion 211 faces the curved portion 221 across the rotational central axis of the compressor impeller 9. The first end surface 211*a* of the curved portion 211 faces the second end surface 221*b* of the curved portion 221 in the circumferential direction. The second end surface 211*b* of the curved portion 211 faces the first end surface 221*a* of the curved portion 221 in the circumferential direction. The first movable portion 210 and the second movable portion 220 are configured so that the curved portions 211 and 221 are movable in the radial direction, as described in detail below.

The connecting portion 230 connects the first movable portion 210 and the second movable portion 220 to the rod 240. The connecting portion 230 is arranged in the accommodation hole 114. In other words, the connecting portion 230 is arranged closer to the inlet 10 with respect to the first movable portion 210 and the second movable portion 220. The connecting portion 230 has a substantially arc shape. A width of the connecting portion 230 in the radial direction is smaller than a width of the accommodation hole 114 in the radial direction. A length of the connecting portion 230 in the circumferential direction is shorter than a length of the accommodation hole 114 in the circumferential direction.

The connecting portion 230 includes a first bearing hole 231 formed at one end and a second bearing hole 232 formed at the other end in the circumferential direction. In the connecting portion 230, the first bearing hole 231 is opened on a surface that faces the first movable portion 210 in the axial direction. In the connecting portion 230, the second bearing hole 232 is opened on a surface that faces the second movable portion 220 in the axial direction. The first bearing hole 231 and the second bearing hole 232 extend in the axial direction. In this embodiment, the first bearing hole 231 and the second bearing hole 232 are non-through holes. However, the first bearing hole 231 and the second bearing hole 232 may pass through the connecting portion 230 in the axial direction.

A rod connector 233 is formed in the connecting portion 230. In the connecting portion 230, the rod connector 233 axially protrudes from a surface spaced apart from the first movable portion 210 and the second movable portion 220. The rod connector 233 has a substantially cylindrical shape. The rod connector 233 is substantially located at a center of the connecting portion 230 in the circumferential direction.

The rod 240 has a substantially cylindrical shape. The rod 240 includes a bearing hole 241 at one end, and is connected to an actuator (described below) at the other end. The bearing hole 241 extends in the axial direction. The size of the bearing hole 241 is slightly larger than the size of the rod connector 233.

An insertion hole (not shown) is formed in the scroll housing 110. One end of the rod 240 is inserted into the insertion hole. The insertion hole restricts a movement of the rod 240 in a direction perpendicular to a central axis. The insertion hole also guides a movement of the rod 240 in a central axis direction.

The bearing hole 241 of the rod 240 is arranged in the insertion hole. A connecting hole 116 communicating with the accommodation hole 114 is formed in the inner wall of the insertion hole. The connecting hole 116 is substantially formed at a middle of the accommodation hole 114 in the circumferential direction. In the connecting hole 116, a width in the central axis direction of the rod 240 is greater than a width in a direction orthogonal to the central axis direction of the rod 240. In other words, the connecting hole 116 is an elongated hole. The shorter width of the connecting hole 116 is slightly larger than an outer diameter of the rod connector 233.

The rod connector 233 is inserted into the bearing hole 241 through the connecting hole 116. As such, the rod 240 is connected to the connecting portion 230. The accommodation hole 114 is longer than the connecting portion 230 in the circumferential direction. The accommodating hole 114 is wider than the connecting portion 230 in the radial direction. Accordingly, the connecting portion 230 is allowed to move within the accommodating hole 114 in a plane perpendicular to the rotational center axis of the compressor impeller 9.

The first movable portion 210 and the second movable portion 220 are accommodated in the accommodation groove 112. In other words, the first movable portion 210 and the second movable portion 220 are accommodated in the gap S formed between the scroll housing 110 and the shroud piece 120. An inner diameter of the accommodation groove 112 is larger than an outer diameter of the curved portion 211 of the first movable portion 210. The inner diameter of the accommodating groove 112 is larger than an outer diameter of the curved portion 221 of the second movable portion 220. Accordingly, the first movable portion 210 and the second movable portion 220 are allowed to move within the accommodation groove 112 in the plane perpendicular to the rotational center axis of the compressor impeller 9.

The first movable portion 210 includes a connecting shaft 213 and a rotational shaft 214. In the first movable portion 210, the connecting shaft 213 and the rotational shaft 214 protrude in the axial direction from a surface closer to the inlet 10. The connecting shaft 213 extends substantially parallel to the rotational shaft 214. The connecting shaft 213 and the rotational shaft 214 have a substantially cylindrical shape.

An outer diameter of the connecting shaft 213 is smaller than an inner diameter of the first bearing hole 231 of the connecting portion 230. The connecting shaft 213 is inserted into the first bearing hole 231. The connecting shaft 213 is rotatably supported by the first bearing hole 231. An outer diameter of the rotational shaft 214 is smaller than an inner diameter of the bearing hole 113 of the scroll housing 110. The rotational shaft 214 is inserted into the vertically upper bearing hole 113 of the two bearing holes 113. The rotational shaft 214 is rotatably supported by the bearing hole 113.

The second movable portion 220 includes a connecting shaft 223 and a rotational shaft 224. In the second movable portion 220, the connecting shaft 223 and the rotational shaft 224 protrude in the axial direction from a surface closer to the inlet 10. The connecting shaft 223 extends substantially parallel to the rotational shaft 224. The connecting shaft 223 and the rotational shaft 224 have a substantially cylindrical shape.

An outer diameter of the connecting shaft 223 is smaller than an inner diameter of the second bearing hole 232 of the connecting portion 230. The connecting shaft 223 is inserted into the second bearing hole 232. The connecting shaft 223 is rotatably supported by the second bearing hole 232. An outer diameter of the rotational shaft 224 is smaller than the inner diameter of the bearing hole 113 of the scroll housing 110. The rotational shaft 224 is inserted into the vertically lower bearing hole 113 of the two bearing holes 113. The rotational shaft 224 is rotatably supported by the bearing hole 113.

As such, the link mechanism 200 includes a four-bar linkage. The four links (nodes) are the first movable portion 210, the second movable portion 220, the scroll housing 110, and the connecting portion 230. Since the link mechanism 200 includes the four-bar linkage, it is a limited chain and has one degree of freedom, which makes it easy to control.

Figure 4:
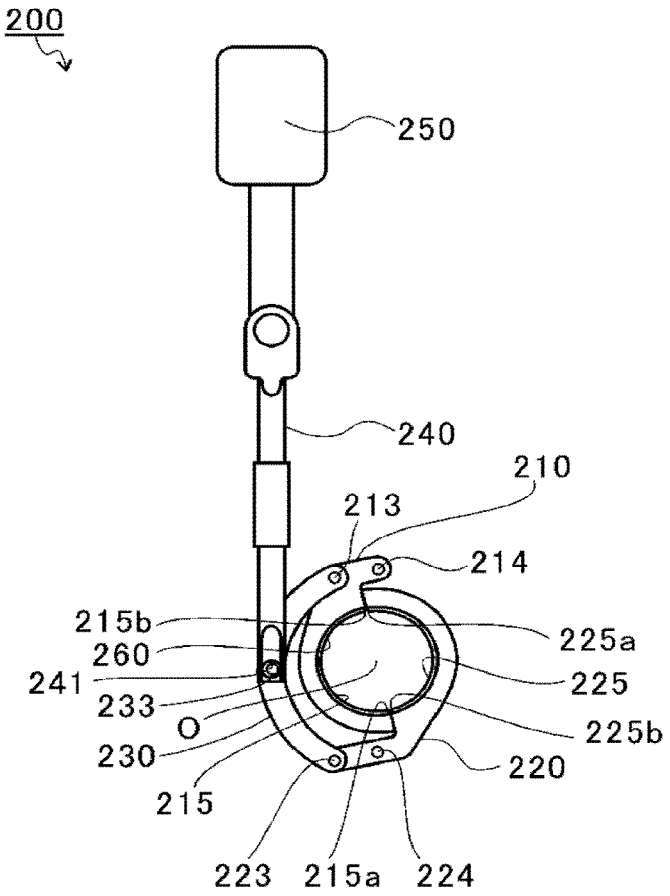
FIG. 4 is a first illustration of an operation of a link mechanism.

FIG. 4 is a first illustration of an operation of the link mechanism 200. In the following FIGS. 4, 5 and 6, the link mechanism 200 is seen from the inlet 10. As shown in FIG. 4, the rod 240 is connected to a drive shaft of an actuator 250.

In the arrangement shown in FIG. 4, the first movable portion 210 and the second movable portion 220 are in contact with each other. In this state, as shown in FIGS. 2 and 3, a protrusion 215 that is a radially inner part of the first movable portion 210 protrudes (is exposed) into the intake flow path 130. A protrusion 225 that is a radially inner part of the second movable portion 220 protrudes (is exposed) into the intake flow path 130. The positions of the first movable portion 210 and the second movable portion 220 in this state is referred to as a protruding position (or a throttling position).

As shown in FIG. 4, in the protruding position, circumferential ends 215*a* and 215*b* of the protrusion 215 and circumferential ends 225*a* and 225*b* of the protrusion 225 are in contact with each other. An annular hole 260 is formed by the protrusion 215 and the protrusion 225. An inner diameter of the annular hole 260 is smaller than the inner diameter of the intake flow path 130 at a position where the protrusions 215 and 225 protrude. For example, the inner diameter of the annular hole 260 is smaller than the inner diameter of the intake flow path 130 at any positions.

Figure 5:
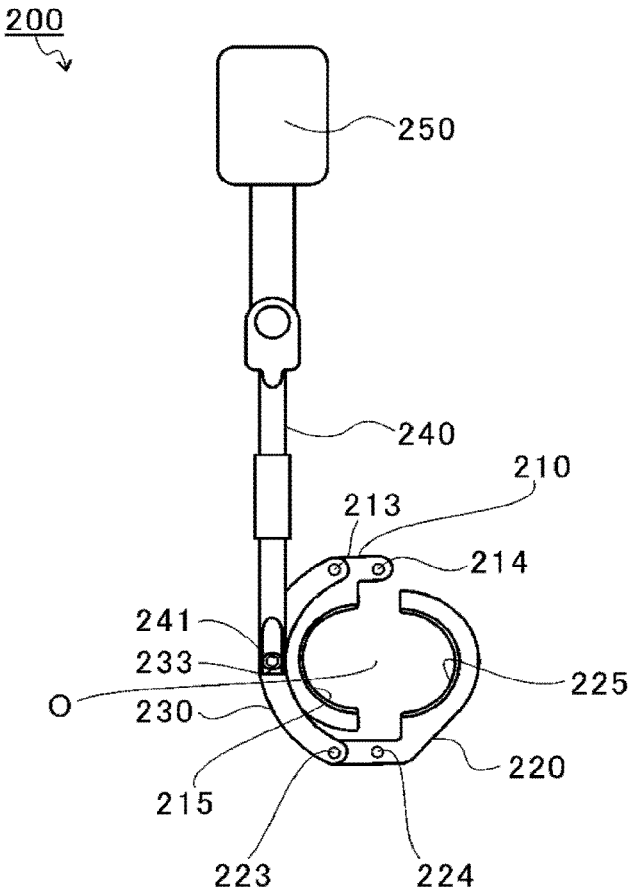
FIG. 5 is a second illustration of the operation of the link mechanism.
Figure 6:
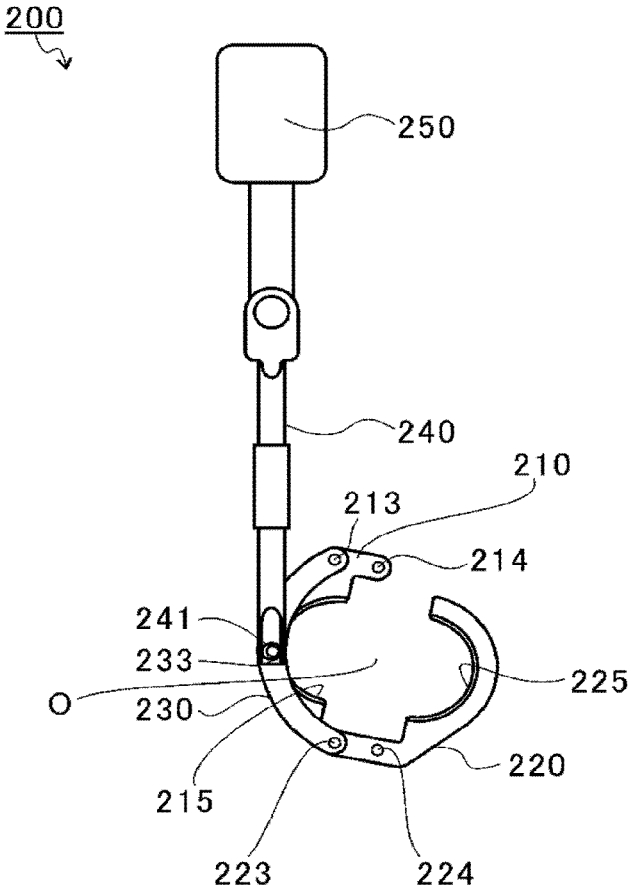
FIG. 6 is a third illustration of the operation of the link mechanism.

FIG. 5 is a second illustration of the operation of the link mechanism 200. FIG. 6 is a third illustration of the operation of the link mechanism 200. The actuator 250 linearly moves the rod 240 in a direction (up-and-down direction in FIGS. 5 and 6) that intersects the axial direction of compressor impeller 9. In FIGS. 5 and 6, the rod 240 moves upward from the position shown in FIG. 4. The movement of the rod 240 with respect to the arrangement in FIG. 4 is larger in the arrangement in FIG. 6 than in the arrangement in FIG. 5.

As the rod 240 moves, the connecting portion 230 is moved upward in FIGS. 5 and 6 via the rod connector 233. In this state, the connecting portion 230 is allowed to rotate around the rod connector 233. Furthermore, the inner diameter of the bearing hole 241 of the rod 240 has a small amount of play with respect to the outer diameter of the rod connector 233. Accordingly, the connecting portion 230 is allowed to slightly move in the plane direction perpendicular to the axial direction of the compressor impeller 9.

As described above, the link mechanism 200 is a four-bar linkage. The connecting portion 230, the first movable portion 210, and the second movable portion 220 exhibit a one-degree-of-freedom behavior with respect to the scroll housing 110. Specifically, the connecting portion 230 slightly rotates in a counterclockwise direction and slightly moves in the left-to-right direction in FIGS. 5 and 6 within the above-described allowable range.

The rotational shaft 214 of the first movable portion 210 is supported by the scroll housing 110. The rotational shaft 214 is prevented from moving in the plane direction perpendicular to the axial direction of the compressor impeller 9. The connecting shaft 213 is supported by the connecting portion 230. Since the connection portion 230 is allowed to move, the connecting shaft 213 is movable in the plane direction perpendicular to the axial direction of the compressor impeller 9. As a result, as the connecting portion 230 moves, the first movable portion 210 rotates around the rotational shaft 214 in a clockwise direction in FIGS. 5 and 6.

Similarly, the rotational shaft 224 of the second movable portion 220 is supported by the scroll housing 110. The rotational shaft 224 is prevented from moving in the plane direction perpendicular to the axial direction of the compressor impeller 9. The connecting shaft 223 is supported by the connecting portion 230. Since the connection portion 230 is allowed to move, the connecting shaft 223 is movable in the plane direction perpendicular to the axial direction of the compressor impeller 9. As a result, as the connecting portion 230 moves, the second movable portion 220 rotates around the rotational shaft 224 in the clockwise direction in FIGS. 5 and 6.

Thus, the first movable portion 210 and the second movable portion 220 move in directions spaced apart from each other in the order of FIG. 5 and FIG. 6. The protrusions 215 and 225 move to positions (retracted position) that are radially outside the protruding position. In the retracted position, for example, the protrusions 215 and 225 are flush with the inner wall of the intake flow path 130, or are positioned radially outside the inner wall of the intake flow path 130. When moving from the retracted position to the protruding position, the first movable portion 210 and the second movable portion 220 approach each other and come into contact with each other in the order of FIG. 6, FIG. 5, and FIG. 4. As such, the first movable portion 210 and the second movable portion 220 are switched between the protruding position and the retracted position according to the rotational angle around the rotational shafts 214 and 224.

Accordingly, the first movable portion 210 and the second movable portion 220 are configured to be movable between the protruding position protruding into the intake flow path 130, and the retracted position retracted from the intake flow path 130. In this embodiment, the first movable portion 210 and the second movable portion 220 are move in the radial direction of the compressor impeller 9. However, the first movable portion 210 and the second movable portion 220 are not limited thereto, and may rotate around the rotational axis of the compressor impeller 9 (in the circumferential direction) to move between the protruding position and the retracted position. For example, the first movable portion 210 and the second movable portion 220 may be shutter blades including two or more blades.

When the first movable portion 210 and the second movable portion 220 are in the retracted position (hereinafter also referred to as a retracted position state), they do not protrude into the intake flow path 130. Therefore, the pressure loss of the intake air (air) flowing in the intake flow path 130 is reduced.

As shown in FIG. 2, when the first movable portion 210 and the second movable portion 220 are in the protruding position (hereinafter also referred to as a protruding position state), the protrusions 215 and 225 protrude into the intake flow path 130. In other words, the protrusions 215 and 225 are arranged within the intake flow path 130. When the protrusions 215, 225 protrude into the intake flow path 130, the cross-sectional area of the intake flow path 130 decreases.

As the flow rate of the air flowing into the compressor impeller 9 decreases, the air compressed by the compressor impeller 9 may flow backward through the intake flow path 130 (i.e., the air may flow from the downstream side to the upstream side). In other words, as the flow rate of air flowing into the compressor impeller 9 decreases, a backflow phenomenon called surging may occur.

In the protruding position state shown in FIG. 2, the protrusions 215 and 225 are located radially inward with respect to the outermost radial end of the leading-edge LE of the compressor impeller 9. As a result, the air flowing backward in the intake flow path 130 is blocked by the protrusions 215 and 225. Therefore, the first movable portion 210 and the second movable portion 220 can reduce the backflow of air in the intake flow path 130.

As the cross-sectional area of the intake flow path 130 decreases, the velocity of the air flowing into the compressor impeller 9 increases. This reduces the angle of incidence to the blades of the compressor impeller 9 and stabilizes the air flow. As a result, the occurrence of surging in the centrifugal compressor CC can be prevented. In other words, the centrifugal compressor CC of this embodiment can expand the operational range in the smaller flow rate area of the centrifugal compressor CC by protruding the protrusions 215 and 225 into the intake flow path 130.

As such, the first movable portion 210 and the second movable portion 220 are configured as throttling portions that throttle the intake flow path 130. In other words, in this embodiment, the link mechanism 200 is configured as a throttling mechanism that throttles the intake flow path 130. The link mechanism 200 can change the cross-sectional area of the flow path 130 by moving the first movable portion 210 and the second movable portion 220.

Figure 7:
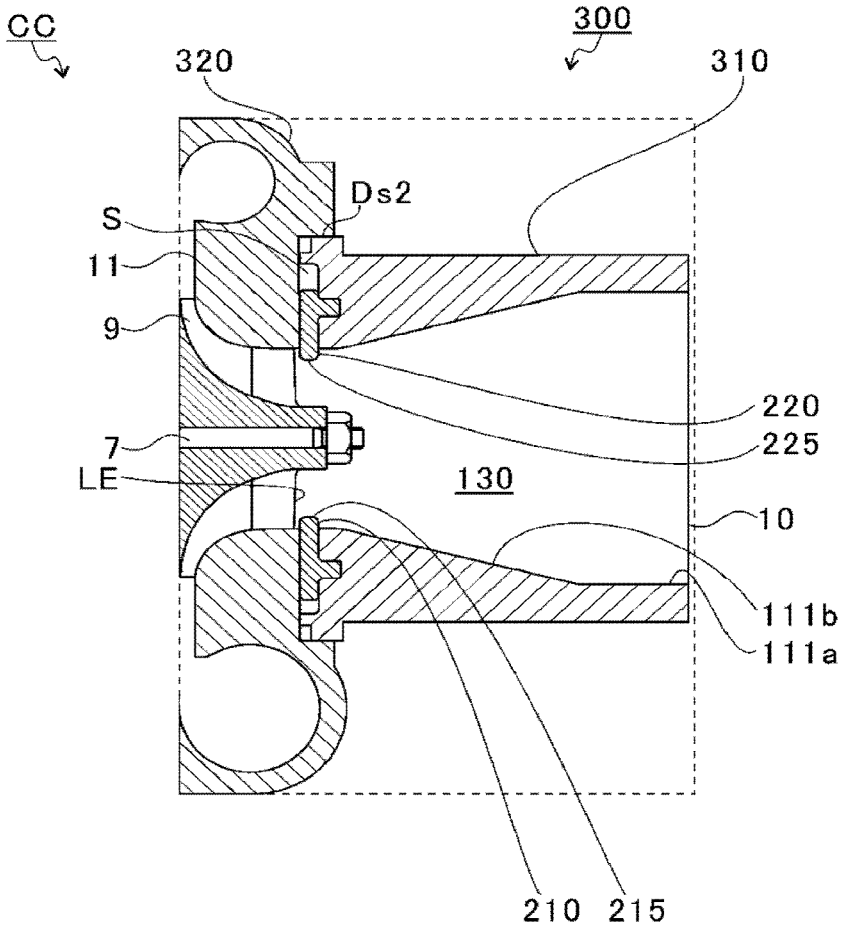
FIG. 7 is a schematic cross-sectional view showing a structure of a compressor housing of a comparative example.

FIG. 7 is a schematic cross-sectional view of a compressor housing 300 in a comparative example. Components that are substantially equivalent to those of the centrifugal compressor CC of the above embodiment will be assigned with the same reference signs, and omitted from explanations.

As shown in FIG. 7, the compressor housing 300 in the comparative example is divided into a first compressor housing 310 and the second compressor housing 320. A gap S is formed between the first compressor housing 310 and the second compressor housing 320. The first movable portion 210 and the second movable portion 220 are arranged in the gap S.

In the compressor housing 300 of the comparative example, split surfaces Ds2 between the first compressor housing 310 and the second compressor housing 320 are exposed to the outside. The split surfaces Ds2 connect the outside of the compressor housing 300 to the inside. The split surfaces Ds2 may allow foreign matter to enter inside the compressor housing 300 from the outside.

Figure 8:
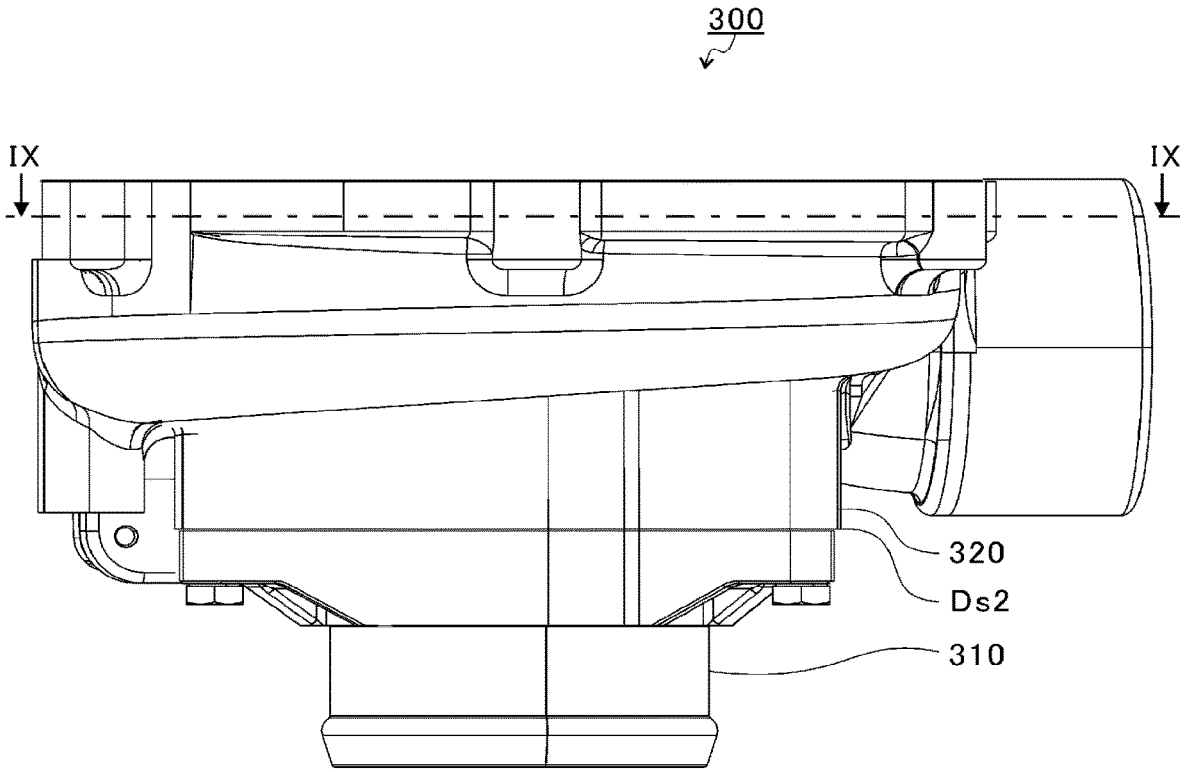
FIG. 8 is a schematic side view of the compressor housing of the comparative example.

FIG. 8 is a schematic side view of the compressor housing 300 of the comparative example. As shown in FIG. 8, when assembling the compressor housing 300 of the comparative example, the first compressor housing 310 is placed vertically downward and the second compressor housing 320 is placed vertically upward. Then, the second compressor housing 320 is moved closer to the first compressor housing 310 from vertical upward toward vertical downward to connect the first compressor housing 310 and the second compressor housing 320 to each other. As such, the compressor housing 300 of the comparative example is assembled.

Figure 9:
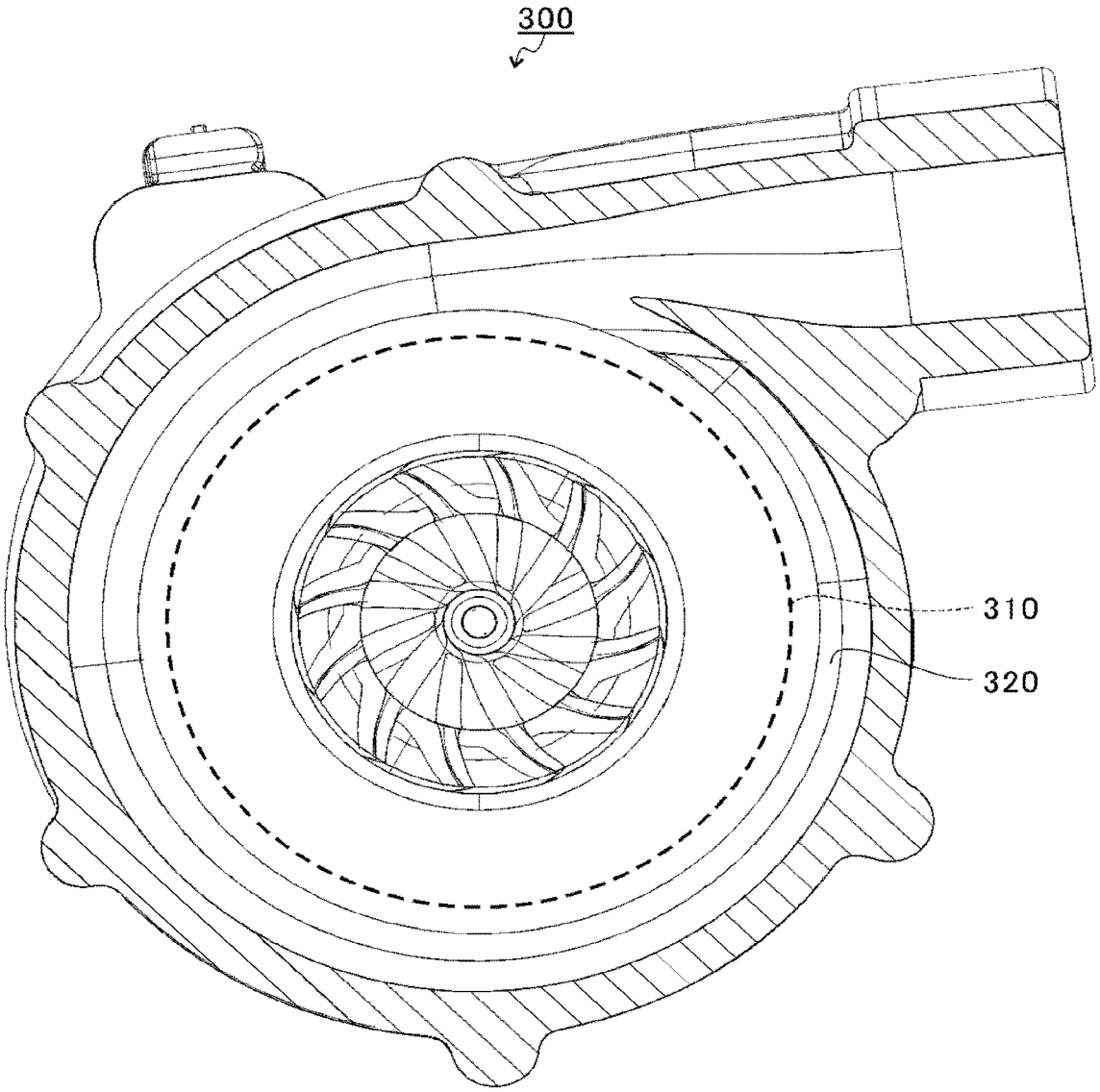
FIG. 9 is a cross-sectional view taken along IX-IX line in FIG. 8 of the compressor housing of the comparative example.

FIG. 9 is a cross-sectional view taken along IX-IX line in FIG. 8 of the compressor housing 300 of the comparative example. As shown in FIG. 9, the maximum outer diameter of the first compressor housing 310 is smaller than the maximum outer diameter of the second compressor housing 320. Accordingly, when the second compressor housing 320 is assembled from vertically upward of the first compressor housing 310, it is difficult to see the first compressor housing 310. As a result, the assembling of the compressor housing 300 is difficult.

Figure 10:
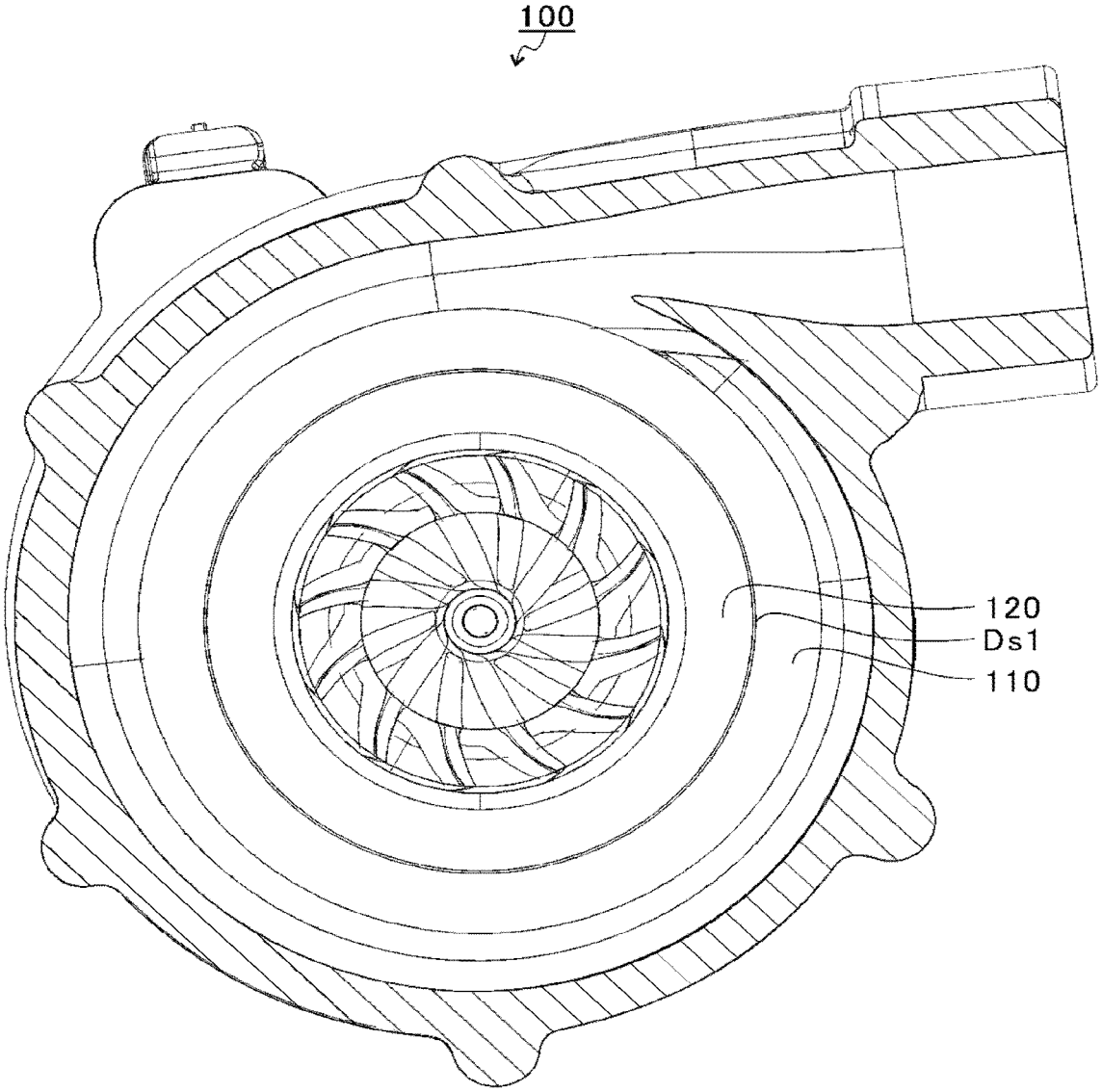
FIG. 10 is a cross-sectional view taken along X-X line in FIG. 2 of the compressor housing of the embodiment.

FIG. 10 is a cross-sectional view taken along X-X line in FIG. 2 of the compressor housing 100 of the embodiment. As shown in FIG. 10, the compressor housing 100 of this embodiment includes the scroll housing 110 and the shroud piece 120. The split surfaces Ds1 between the scroll housing 110 and the shroud piece 120 are located within the compressor housing 100. In other words, the split surfaces Ds1 are not exposed to the outside of the compressor housing 100. According to the compressor housing 100 of this embodiment, entering of foreign matter can be prevented, compared to the compressor housing 300 in the comparative example in which the split surfaces Ds2 are exposed to the outside as shown in FIG. 7.

Furthermore, when assembling the compressor housing 100 of this embodiment, the scroll housing 110 is placed vertically downward and the shroud piece 120 is placed vertically upward. Then, the shroud piece 120 is moved closer to the scroll housing 110 from vertically upward toward vertically downward to connect the scroll housing 110 and shroud piece 120 to each other. As such, the compressor housing 100 of this embodiment is assembled.

As shown in FIG. 10, the maximum outer diameter of the shroud piece 120 is smaller than the maximum outer diameter of the scroll housing 110. Accordingly, when assembling the shroud piece 120 from vertically upward of the scroll housing 110, the shroud piece 120 can be seen to assemble. As a result, the compressor housing 100 is easier to assemble.

Figure 11:
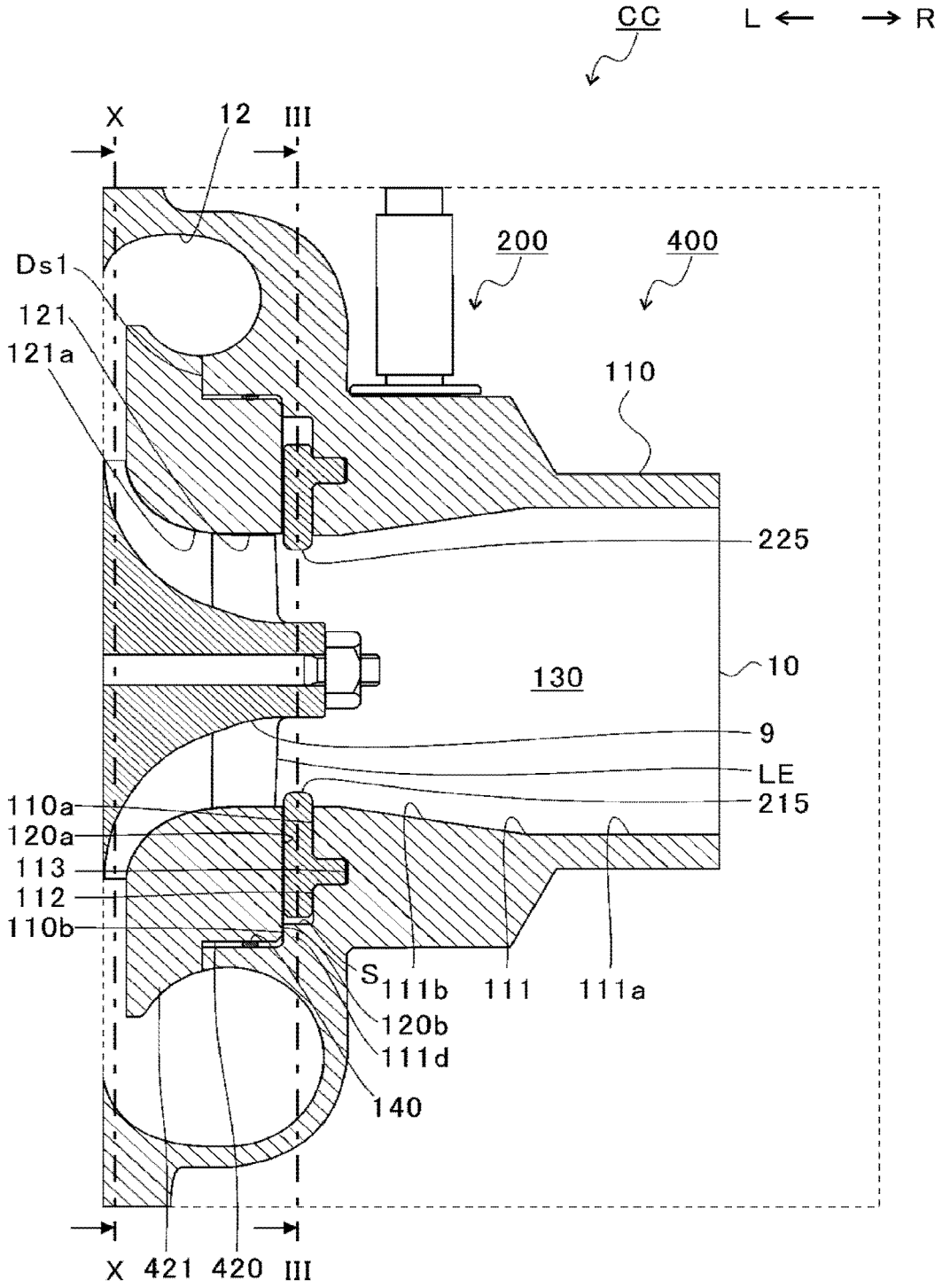
FIG. 11 is a schematic cross-sectional view showing a structure of a compressor housing of a first variant.

FIG. 11 is a schematic cross-sectional view of a compressor housing 400 in a first variant. Components that are substantially equivalent to those of the centrifugal compressor CC of the above embodiment will be assigned with the same reference signs, and omitted from explanations. The compressor housing 400 of the first variant differs from the above embodiment in the configuration of a shroud piece 420. Other configurations are the same as those of the compressor housing 100 of the above embodiment.

The shroud piece 420 of the first variant includes a shroud portion 121*a* and a protrusion 421. The shroud portion 121*a* has a substantially constant outer diameter that is smaller than the minimum inner diameter of the compressor scroll flow path 12. The protrusion 421 has a substantially annular shape. The protrusion 421 is provided downstream of the shroud portion 121*a*. The protrusion 421 projects radially outward from the shroud portion 121*a*. The protrusion 421 forms a part of an inner surface of the compressor scroll flow path 12. The maximum outer diameter of the protrusion 421 is smaller than the maximum outer diameter of the scroll housing 110. The split surfaces Ds1 communicate with an area upstream of the protrusion 421. The split surfaces Ds1 include one end located on the inner surface of the compressor scroll flow path 12, and the other end located on the inner surface of the intake flow path 130 at a position upstream of the leading-edge LE. In the first variant, the split surfaces Ds1 extend between the compressor scroll flow path 12 and the intake flow path 130. The split surfaces Ds1 are located in the compressor housing 400 from one end to the other end. The split surfaces Ds1 are not exposed on the outer surface of the compressor housing 400.

According to the first variant, the same functions and effects as those in the above embodiment can be obtained. Furthermore, the shroud piece 420 of the first variant forms part of the inner surface of the compressor scroll flow path 12. This facilitates the manufacturing (casting) of the shroud piece 120 with the compressor scroll flow path 12.

Figure 12:
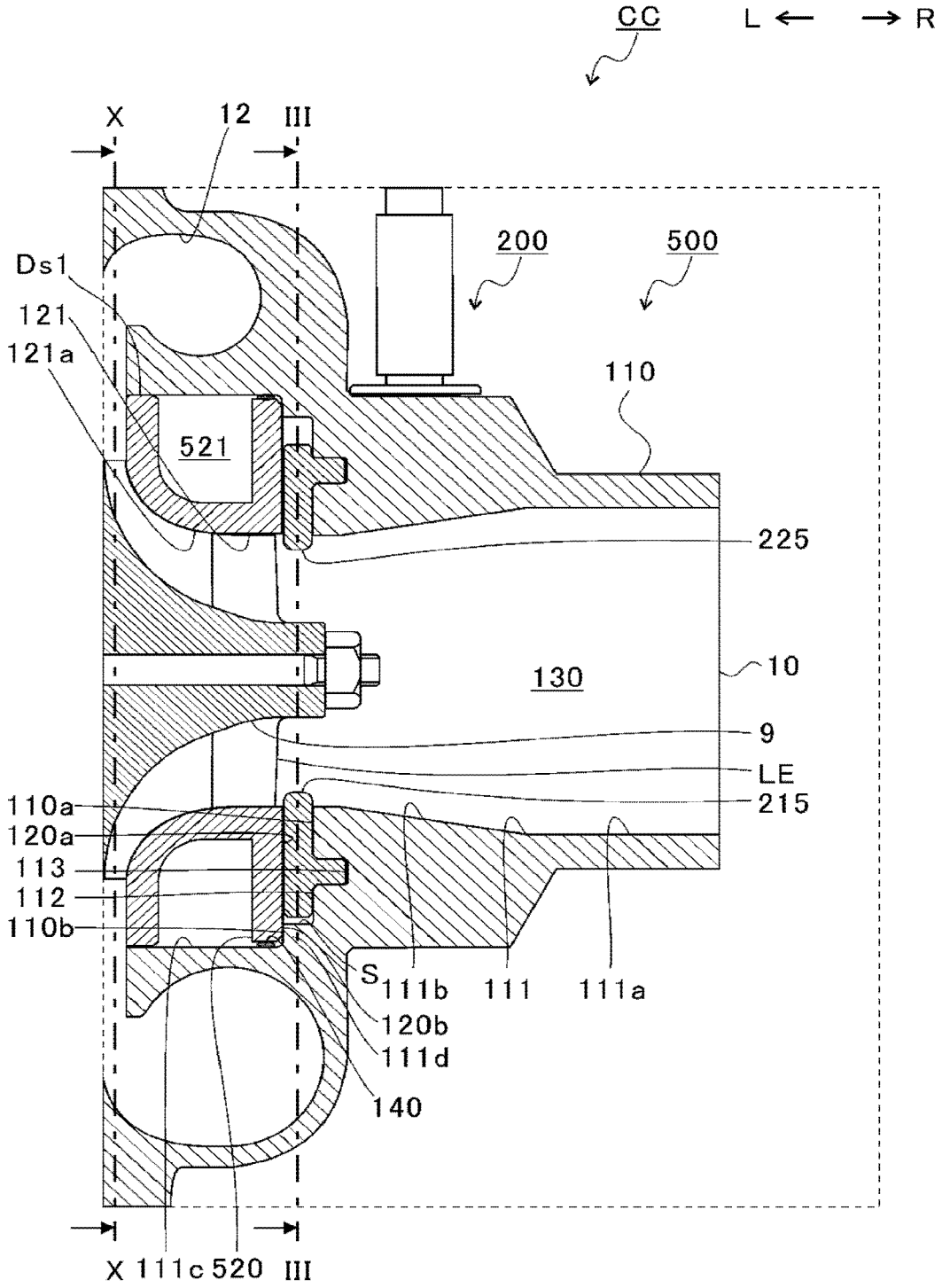
FIG. 12 is a schematic cross-sectional view showing a structure of a compressor housing of a second variant.

FIG. 12 is a schematic cross-sectional view of a compressor housing 500 in a second variant. Components that are substantially equivalent to those of the centrifugal compressor CC of the above embodiment will be assigned with the same reference signs, and omitted from explanations. The compressor housing 500 of the second variant differs from the above embodiment in the configuration of a shroud piece 520. Other configurations are the same as those of the compressor housing 100 of the above embodiment.

The shroud piece 520 of the second variant includes a hollow section 521. The hollow section 521 does not open on the inner surface of the shroud piece 520. The hollow section 521 opens on the outer surface of the shroud piece 520. However, the hollow section 521 may not open on the outer surface of the shroud piece 520. For example, the hollow section 521 may be formed as a sealed space inside the shroud piece 520 without opening to the outside of the shroud piece 520. In other words, the hollow section 521 forms a sealed space inside the shroud piece 520. The hollow section 521 hardly communicates with intake air flowing outside the shroud piece 520.

According to the second variant, the same functions and effects as those in the above embodiment can be obtained. Furthermore, the shroud piece 520 of the second variant includes a hollow portion 521. This allows the compressor housing 500 of the second variant to be lighter than the compressor housings 100 and 400 of the above embodiment and the first variant. In addition, an air layer is formed in the hollow section 521. Therefore, when the hollow section 521 is formed in the shroud piece 520, the heat shielding property can be increased, compared to the case where the hollow section 521 is not formed.

Although the embodiments of the present disclosure have been described above with reference to the accompanying drawings, the present disclosure is not limited thereto. It is obvious that a person skilled in the art can conceive of various examples of variations or modifications within the scope of the claims, which are also understood to belong to the technical scope of the present disclosure.

In the above embodiment, the first variation and the second variation, the gap S is formed upstream of the compressor impeller 9 in the flow of the intake air. However, the gap S is not limited thereto, and may be formed downstream of the compressor impeller 9 in the flow of the intake air. For example, the gap S may be formed between the compressor impeller 9 and the compressor scroll flow path 12. In other words, the gap S may be connected to the diffuser flow path 11. As such, the gap S may be formed between the scroll housing 110 and the shroud piece 120, 420, 520.

In the above embodiment, the first variant and the second variant, the seal 140 is provided between the hollow portion 111*c* and the shroud piece 120. However, the seal 140 is not essential. For example, when the shroud piece 120, 420, 520 is press-fitted into the scroll housing 110, the seal 140 may not be provided.

What is claimed is:

1. A centrifugal compressor comprising:

a scroll housing including a scroll flow path;

a shroud piece attached to the scroll housing at a position radially inside the scroll flow path and including a shroud portion that faces a compressor impeller in a radial direction; and a throttling portion arranged in a gap formed between the scroll housing and the shroud piece, wherein the scroll housing includes a contacting portion that is arranged radially outside the throttling portion and that contacts the shroud piece in an axial direction of the compressor impeller, and the contacting portion contacts an axial end surface of the shroud piece in the axial direction, the axial end surface forming the gap.

2. The centrifugal compressor according to claim 1, wherein the throttling portion is arranged at a position spaced apart from the shroud portion with respect to a leading-edge of the compressor impeller.

3. The centrifugal compressor according to claim 1, comprising a seal arranged between the scroll housing and the shroud piece.

4. The centrifugal compressor according to claim 1, wherein the shroud piece forms a part of an inner surface of the scroll flow path.

5. The centrifugal compressor according to claim 1, wherein the shroud piece includes an abradable material.

6. The centrifugal compressor according to claim 1, wherein the shroud piece includes a hollow section.

* * * * *